US009457564B2

(12) United States Patent
Mawatari

(10) Patent No.: US 9,457,564 B2
(45) Date of Patent: Oct. 4, 2016

(54) INKJET HEAD, METHOD FOR DRIVING SAME, AND INKJET PRINTER

(71) Applicant: KONICA MINOLTA, INC., Chiyoda-ku (JP)

(72) Inventor: Kenji Mawatari, Chiyoda-ku (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/890,377

(22) PCT Filed: Mar. 13, 2014

(86) PCT No.: PCT/JP2014/056600

§ 371 (c)(1),
(2) Date: Nov. 10, 2015

(87) PCT Pub. No.: WO2014/185142

PCT Pub. Date: Nov. 20, 2014

(65) Prior Publication Data

US 2016/0082723 A1 Mar. 24, 2016

(30) Foreign Application Priority Data

May 13, 2013 (JP) ..... 2013-100998

(51) Int. Cl.
*B41J 2/45* (2006.01)
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04588* (2013.01); *B41J 2/04591* (2013.01); *B41J 2/04595* (2013.01); *B41J 2/14233* (2013.01)

(58) Field of Classification Search
CPC ..... B41J 2/14202; B41J 2002/14491; B41J 2202/18; B41J 2/04501; B41J 2/14314; B41J 2/0459
See application file for complete search history.

(56) References Cited

U.S. PATENT DOCUMENTS

| | | | |
|---|---|---|---|
| 6,099,103 | A | 8/2000 | Takahashi |
| 6,709,091 | B1 | 3/2004 | Takahashi |
| 2011/0175956 | A1 | 7/2011 | Tsukamoto |

FOREIGN PATENT DOCUMENTS

| | | |
|---|---|---|
| JP | 61-22959 | 1/1986 |
| JP | 10-296975 | 11/1998 |
| JP | 3168699 | 3/2001 |
| JP | 2004-188990 | 7/2004 |
| JP | 2011-143682 | 7/2011 |
| JP | 2011-183550 | 9/2011 |
| JP | 2012-126046 | 7/2012 |

*Primary Examiner* — Lamson Nguyen
(74) *Attorney, Agent, or Firm* — Cozen O'Connor

(57) ABSTRACT

A drive signal applied to a thin-film piezoelectric element includes the following: at least one discharge pulse that causes a drop of ink to be discharged from a pressure chamber; and a cancellation pulse. Said cancellation pulse has the same polarity as the discharge pulse(s) and serves to suppress reverberations of a pressure wave applied to the pressure chamber when the thin-film piezoelectric element is driven by the application of the discharge pulse(s). Letting Tc represent half of the natural vibration period of the pressure chamber, within the period within which a single pixel is placed, the cancellation pulse is applied once an amount of time equal to Tc times an even integer greater than or equal to 4 has passed since the end of the application of the first discharge pulse.

11 Claims, 11 Drawing Sheets

<EXAMPLE 1>

<EXAMPLE 2>

<COMPARATIVE EXAMPLE 1>

<t=2Tc>

<t=Tc>

INKJET HEAD, METHOD FOR DRIVING SAME, AND INKJET PRINTER

RELATED APPLICATIONS

This is a U.S. National stage of International application No. PCT/JP2014/056600 filed on Mar. 13, 2014. This patent application claims the priority of Japanese application no. 2013-100998 filed May 13, 2013 the disclosure content of which is hereby incorporated by reference.

TECHNICAL FIELD

The present invention relates to an ink-jet head that applies a driving signal to a thin-film piezoelectric element to discharge ink in a pressure chamber to outside, a method for driving the ink-jet head, and an ink-jet printer that includes the ink-jet head.

BACKGROUND ART

Conventionally, an ink-jet printer is known which includes an ink-jet head having a plurality of channels that discharge ink. By moving relatively the ink-jet head with respect to recording mediums such as a paper sheet, a cloth and the like and controlling an ink discharge, it is possible to output a two-dimensional image onto the recording mediums. It is possible to perform the ink discharge by using an actuator (piezoelectric type, electrostatic type, thermal deformation type and the like), or generating a bubble in ink in a tube by heating. Among others, an actuator of the piezoelectric type has advantages of a large output, possible modulation, high response, accepting any type of ink and the like, and is widespread in recent years.

As the actuators of the piezoelectric type, there are actuators that use a bulk piezoelectric material and actuators that use a thin-film piezoelectric material. The former has a large output, accordingly, can discharge a large liquid drop, but is large in size and costly. In contrast, the latter has a small output, accordingly, cannot output a large liquid drop, but is small in size and inexpensive. To realize a printer that has a high resolution (small liquid drop is enough), small size, and low cost, it can be said that it is appropriate to compose an actuator by using a piezoelectric thin film.

A piezoelectric thin film is sandwiched between a pair of electrodes (upper electrode, lower electrode) and located on a driven film (diaphragm) that composes an upper wall of a pressure chamber. With ink stored in the pressure chamber, by applying a voltage (drive signal) to the pair of electrodes to extend and shrink the piezoelectric thin film and vibrating the diaphragm, a pressure is given to the ink in the pressure chamber. In this way, it is possible to discharge the ink in the pressure chamber to outside. By arranging such actuators of the piezoelectric type in a lateral direction, an ink-jet head is composed.

As a method for discharging the ink from the pressure chamber, because of being effective in a stable ink discharge, a drawing-hitting method is widespread, in which a volume of the pressure chamber is temporarily expanded, thereafter, shrunk to discharge the ink. In the drawing-hitting method, a constant voltage (a standby potential at this time is V1) is applied to the actuator during a standby time to deform the diaphragm by a predetermined amount, the potential is dropped to V0 (<V1) at an ink discharge time, thereafter, returned to the standby potential V1, whereby the expansion and shrinkage of the volume of the pressure chamber are performed.

As a piezoelectric material used in the above actuator of the dielectric type, metallic oxides of perovskite type such as $BaTiO_3$, Pb $(Ti/Zr)O_3$ called PZT and the like are widespread. The actuator using a piezoelectric thin film is produced by depositing, for example, PZT on a substrate. It is possible to perform the deposition of PZT by using various methods such as a sputtering method, a CVD (Chemical Vapor Deposition) method, a sol-gel method and the like. In the meantime, crystallization of a piezoelectric material needs a high temperature. Accordingly, Si is often used for the substrate.

In the meantime, in recent years, the ink-jet printer is required to form a high-definition image at a high speed. Following this, an ink discharge waveform (drive waveform) of the ink-jet head is required to shorten a drive period per one pixel and perform multi-gradation.

However, if an interval between the ink discharges becomes short because of the high-speed drive, a reverberation of a pressure wave, which is generated in the pressure chamber by a discharge pulse applied immediately before, occurs and changes an ink discharge speed of the ink discharged next, so that it is impossible to stably discharge the ink. Because of this, in the high-speed drive, after the application of the discharge pulse, it becomes necessary to apply a cancel pulse for curbing the reverberation of the pressure wave to the actuator.

On the other hand, as to the multi-gradation, there is a method, in which a drive waveform is output by using an analog circuit, a shape of the drive waveform is changed to change a size of a discharged ink drop, so that the multi-gradation is achieve. But, in this case, a complicated and costly drive circuit becomes necessary.

Accordingly, in a patent literature 1, by applying a discharge pulse a plurality of times continuously in accordance with a natural vibration period of a pressure chamber, ink drops discharged per one pixel are increased and the multi-gradation drawing is achieved. In this method, because the discharge pulse is applied in accordance with the natural vibration period, influence of the reverberation becomes large, and it is necessary to apply the above cancel pulse for the high-speed stable drive.

Here, as waveforms of the cancel pulse, there is a pulse having a polarity opposite to the discharge pulse and a pulse having the same polarity as the discharge pulse. To quickly curb the reverberation, as described in a patent literature 2, it is effective to use the pulse as the cancel pulse having the polarity opposite to the discharge pulse. But, in a head using a thin-film piezoelectric element, a film thickness of the piezoelectric element is thin and an electric field (voltage per unit thickness) acting on the element is large. Because of this, in the drawing-hitting method, if the pulse having the polarity opposite to the discharge pulse is applied, there are concerns that the applied voltage exceeds a withstand voltage of the element, insulation breakdown of the element occurs, and reliability cannot be kept. Accordingly, in the head using the thin-film piezoelectric, as described in a patent literature 3, it is effective to use the pulse as the cancel pulse having the same polarity as the discharge pulse.

CITATION LIST

Patent Literature

PLT1: JP-A-S61-22959 (see claims, page 5, line 2 of right upper column to line 2 of left lower column and the like)

PLT2: JP No.: 3168699 (see paragraphs [0017] to [0027], FIG. 1, FIG. 2 and the like)

PLT3: JP-A-2012-126046 (see claim 1, FIG. 6 and the like)

SUMMARY OF INVENTION

Technical Problem

A drive, which discharges one ink drop from the pressure chamber within a period (hereinafter, called a one-pixel period) of drawing one pixel, is called a 1 dpd (drop per dot) drive method. In contrast, a drive method, which discharges two ink drops from the pressure chamber within the one-pixel period, is called a 2 dpd drive method. By combining these drive methods to control the discharge of 0 to 2 ink drops within the one-pixel period, it is possible to perform multi-gradation display.

In the above patent literature 3, to perform the high-speed drive by applying the cancel pulse having the same polarity as the discharge pulse, in the 2 dpd drive method, a pulse width of the second discharge pulse within the one-pixel period is made small, and the cancel pulse to be applied next is applied at the same timing as an application timing of the cancel pulse in the 1 dpd drive method.

But, in such a driving method, the cancel pulse is applied immediately after the application of the second discharge pulse within the one-pixel period. Accordingly, the pressure given to the pressure chamber (ink) by the second discharge pulse is prone to become unstable, and it is impossible to perform the ink discharge stably.

In the meantime, to achieve the stable ink discharge, it is necessary to prolong an interval, which is from the application end time of the second discharge pulse within the one-pixel period to the application start of the cancel pulse having the same polarity, longer than the natural vibration period of the pressure chamber. But, in the method of the patent literature 3, the pulse width of the second discharge pulse within the one-pixel period is made small. Accordingly, if the cancel pulse is applied at the interval equal to, for example, the natural vibration period of the pressure chamber after the application end time of the second discharge pulse, the application timing of the cancel pulse deviates in the 1 dpd drive method and the 2 dpd drive method, and the structure of the drive circuit becomes complicated.

Besides, FIG. 11 shows, in the 1 dpd drive method, drive signals (drive waveforms) respectively at t=2Tc and t=Tc, and pressure waves given to the pressure chamber at drive times based on the drive signals. But, for the sake of description, the drive signals do not include the cancel pulse. In the meantime, Tc indicates a half period (μsec.) of the natural vibration period of the pressure chamber, and t indicates a period (μsec.) of moving from the drawing of a pixel to the drawing of the next pixel.

As shown in the figure, when t=2 Tc, if the discharge pulse (second pulse) for the second pixel is not applied, a waveform of the pressure wave (including the reverberation) generated by the application of the discharge pulse (first pulse) for the first pixel becomes a waveform W1 (one-dot-one-bar line), but, if the second pulse is applied, the waveform and a waveform W2 (two-dot-one-bar line) generated by the second pulse weaken each other with opposite phases, as a result of this, the waveform becomes a waveform indicated by a solid line. In other words, in this case, the ink discharge speed at the second pulse application time becomes lower than the ink discharge speed at the first pulse application time by an amount corresponding to a pressure difference R1.

On the other hand, when t=Tc, at the application time of the second pulse, the pressure wave generated by the application of the first pulse and the pressure wave generated by the application of the second pulse strengthen each other with the same phases. In this case, the ink discharge speed at the second pulse application time becomes higher than the ink discharge speed at the first pulse application time by an amount corresponding to a pressure difference R2.

As described above, in the case where the application of the cancel pulse is not considered, if the period t is shortened (if the driving frequency is made high when a plurality of pixels are drawn), the ink discharge speed changes at every pixel drawing. Accordingly, even in the case of the high-speed drawing, to perform stably the ink discharge at every pixel drawing, it is necessary to reduce sufficiently the reverberation before the application time of the discharge pulse for the next pixel by suitably setting the application timing of the above cancel pulse.

The present invention has been made to solve the above problems, and it is an object of the present invention to provide: an ink-jet head that is able to avoid complication of the drive circuit and perform stably the multi-gradation and high-speed drawing by suitably setting the application timing of the cancel pulse, a drive method of the ink-jet head; and an ink-jet printer that includes the ink-jet head.

Solution to Problem

An ink-jet head according to an aspect of the present invention is an ink-jet head that includes: a pressure chamber that stores ink; a thin-film piezoelectric element that is driven based on a drive signal for discharging the ink in the pressure chamber to outside; and a drive circuit that generates the drive signal and applies the drive signal to the thin-film piezoelectric element, the drive signal includes: at least one discharge pulse that discharges one ink drop from the pressure chamber; and a cancel pulse that has a same polarity as the discharge pulse and curbs a reverberation of a pressure wave which is given to the pressure chamber by the drive of the thin-film piezoelectric due to an application of the discharge pulse, and when a half period of a natural vibration period of the pressure chamber is Tc, the cancel pulse is applied when a time, which is Tc times an even number greater than or equal to 4, elapses after an application of a first discharge pulse ends within a period for drawing one pixel.

A method for driving an ink-jet head is a method for driving an ink-jet head that applies a drive signal to a thin-film piezoelectric element to discharge ink in a pressure chamber to outside, wherein the drive signal includes: at least one discharge pulse that discharges one ink drop from the pressure chamber; and a cancel pulse that has a same polarity as the discharge pulse and curbs a reverberation of a pressure wave which is given to pressure chamber by drive of the thin-film piezoelectric due to an application of the discharge pulse, and when a half period of a natural vibration period of the pressure chamber is Tc, the cancel pulse is applied when a time, which is Tc times an even number greater than or equal to 4, elapses from an application end time of a first discharge pulse within a period for drawing one pixel.

Advantageous Effects of Invention

According to the above ink-jet head and its drive method, it is possible to perform stably multi-gradation and high-speed drawing while avoiding complication of a structure of a drive circuit that applies the drive signal to the thin-film piezoelectric element.

DESCRIPTION OF EMBODIMENTS

An embodiment of the present invention is described hereinafter based on the drawings.

[Inkjet Printer Structure]

Figure 1:
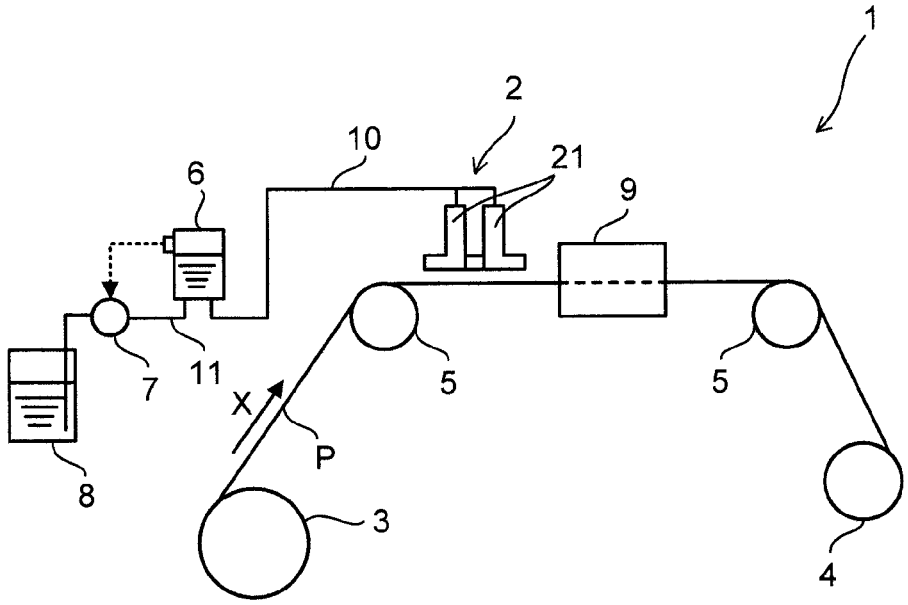
FIG. 1 is a descriptive view showing a schematic structure of an ink-jet printer according to an embodiment of the present invention.

FIG. 1 is a descriptive view showing a schematic structure of an ink-jet printer 1 according to the present embodiment. The ink-jet printer 1 is an ink-jet recording apparatus of so-called line head type in which each of ink-jet heads 21 is disposed in a line in a width direction of a recording medium in an ink-jet head portion 2.

The ink-jet printer 1 includes the above ink-jet head portion 2, a feeding roll 3, a winding roll 4, two back rolls 5•5, an intermediate tank 6, a liquid feeding pump 7, a storing tank 8, and a fixing mechanism 9.

The ink-jet head portion 2 discharges ink from the ink-jet head 21 to a recording medium P to perform image forming (drawing) based on image data, and disposed near one back roll 5. In the meantime, details of the ink-jet head 21 are described later.

The feeding roll 3, the winding roll 4, and each back roll 5 are each a cylindrical member rotatable around a shaft. The feeding roll 3 is a roll that feeds the long recording medium P, which is wound on its circumference in multiple layers, to a position opposing the ink-jet head portion 2. The feeding roll 3 rotates by means of a drive device such as a motor or the like to feed and convey the recording medium P in an X direction in FIG. 1.

The winding roll 4 winds the recording medium P, which is fed by the feeding roll 3 and on which ink is discharged by the ink-jet head portion 2, on its circumference.

Each back roll 5 is disposed between the feeding roll 3 and the winding roll 4. One back roll 5 located in an upstream side in the conveyance direction of the recording medium P winds and supports the recording medium P, which is fed by the feeding roll 3, on a portion of its circumferential surface, and conveys the recording medium P to the position opposing the ink-jet head portion 2. The other back roll 5 winds and supports the recording medium P on a portion of its circumferential surface and conveys the recording medium P from the position opposing the ink-jet head portion 2 to winding roll 4.

The intermediate tank 6 temporarily stores ink supplied from the storing tank 8. Besides, the intermediate tank 6 is connected to a plurality of ink tubes 10, adjusts an ink back pressure in each ink-jet head 21 to supply the ink to each ink-jet head 21.

The liquid feeding pump 7 supplies the ink stored in the storing tank 8 to the intermediate tank 6, and is disposed at a point of a supply tube 11. The ink stored in the storing tank 8 is pumped up by the liquid feeding pump 7 and supplied to the intermediate tank 6 via the supply tube 11.

The fixing mechanism 9 fixes the ink, which is discharged to the recording medium P by the ink-jet head portion 2, onto the recording medium P. The fixing mechanism 9 is composed of: a heater that heats and fixes the discharged ink onto the recording medium P; and a UV lamp that directs UV (ultraviolet rays) to the discharged ink to harden the ink and the like.

In the above structure, the recording medium P fed from the feeding roll 3 is conveyed by the back roll 5 to the position opposing the ink-jet head portion 2, and the ink is discharge from the ink-jet head portion 2 to the recording medium P. Thereafter, the ink discharged to the recording medium P is fixed by the fixing mechanism 9, and the recording medium 9 after the ink fixing is wound by the winding roll 4. As described above, in the ink-jet printer 1 of the line head type, with the ink-jet head portion 2 kept stationary, the ink is discharged while the recording medium P being conveyed, so that an image is formed on the recording medium P.

In the meantime, the ink-jet printer 1 may have a structure in which an image is formed on the recording medium with a serial head method. The serial head method is a method in which while the recording medium being conveyed, the ink-jet head is moved in a direction perpendicular to the conveyance direction to discharge the ink, whereby an image is formed.

[Ink-Jet Head Structure]

Figure 2:
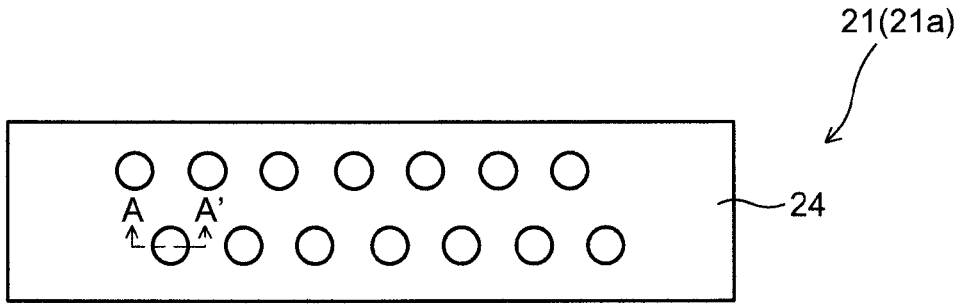
FIG. 2 is a plan view showing a schematic structure of an actuator of an ink-jet head of the above ink-jet printer, and a sectional view taken in an arrow direction of an A-A' line in the plan view.
Figure 2:
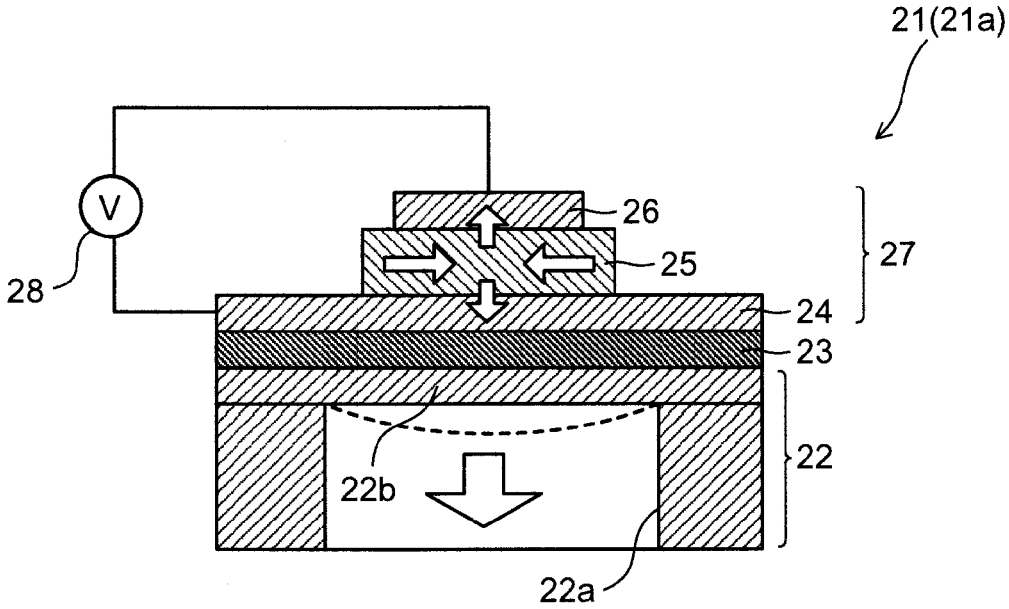
Figure 3:
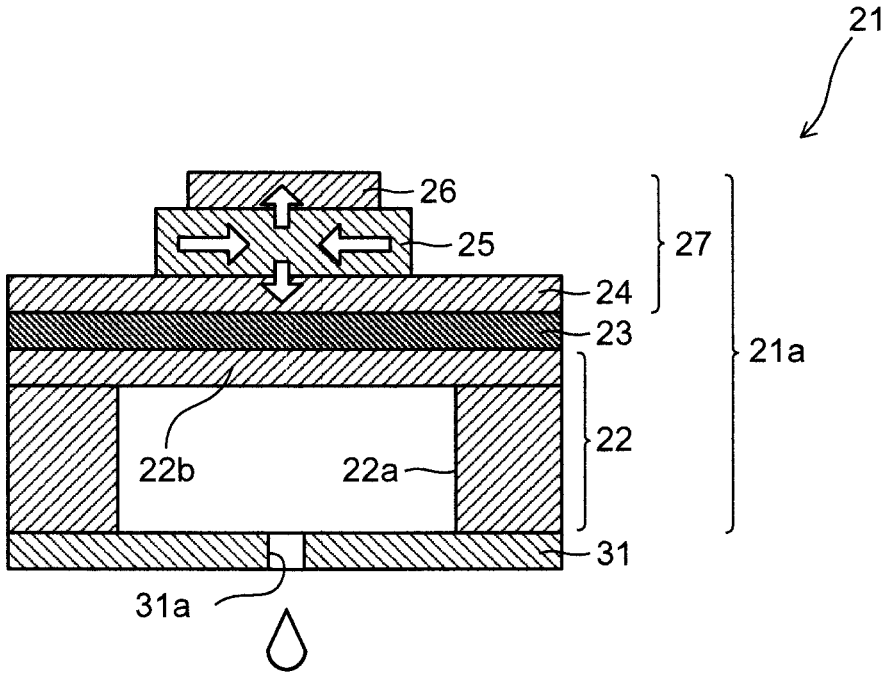
FIG. 3 is a sectional view of the above ink-jet head.

Next, a structure of the above ink-jet head 21 is described. FIG. 2 illustrates a plan view showing a schematic structure of an actuator 21*a* of the ink-jet head 21 along with a sectional view taken in an arrow direction of an A-A' line in the plan view. Besides, FIG. 3 is a sectional view of the ink-jet head 21 in which a nozzle substrate 31 is bonded to the actuator 21*a* in FIG. 2.

The ink-jet head 21 has a thermal oxide film 23, a lower electrode 24, a piezoelectric thin film 25, and an upper electrode 26 in this order on a substrate 22 having a plurality of pressure chambers 22*a*.

The substrate 22 is composed of a semiconductor substrate formed of single crystal Si (silicon) alone having a thickness of, for example, about 300 to 500 μm or a SOI (Silicon on Insulator) substrate. In the meantime, FIG. 2 shows the case where the substrate 22 is composed of the SOI substrate. The SOI substrate is obtained by boding two Si substrates via an oxide film. An upper wall of the pressure chamber 22*a* of the substrate 22 composes a diaphragm 22*b* that serves as a driven film, is displaced (vibrated) by drive (stretch and shrinkage) of the piezoelectric thin film 25 to give a pressure to the ink in the pressure chamber 22*a*.

The thermal oxide film 23 is composed of $SiO_2$ (silicon oxide) having a thickness of, for example, about 0.1 μm, and formed for the purpose of protecting and insulating the substrate 22.

The lower electrode 24 is a common electrode disposed to be common to the plurality of pressure chambers 22*a*, and composed by laminating a Ti (titanium) layer and a Pt (platinum) layer. The Ti layer is formed to improve bonding between the thermal oxide film 23 and the Pt layer. The Ti layer has a thickness of, for example, about 0.02 μm, and the Pt layer has a thickness of, for example, about 0.1 μm.

The piezoelectric thin film 25 is composed of, for example, PZT (lead zirconium titanate), and is disposed correspondingly to each pressure chamber 22*a*. The PZT is a solid solution of PTO ($PbTiO_3$; lead titanate) and PZO ($PbZrO_3$; lead zirconate). The piezoelectric thin film 25 has a film thickness of, for example, 3 to 5 μm.

The upper electrode 26 is a separate electrode disposed correspondingly to each pressure chamber 22*a*, and composed by laminating a Ti layer and a Pt layer. The Ti layer is formed to improve bonding between the piezoelectric thin film 25 and the Pt layer. The Ti layer has a thickness of, for example, about 0.02 μm, and the Pt layer has a thickness of, for example, about 0.1 to 0.2 μm. The upper electrode 26 is disposed to sandwich the piezoelectric thin film 25 with the lower electrode 24.

The lower electrode 24, the piezoelectric thin film 25, and the upper electrode 26 compose a thin-film piezoelectric element 27 that discharges the ink in the pressure chamber 22*a* to outside. The thin-film piezoelectric element 27 is driven based on voltages (drive signals) applied from a drive circuit 28 to the lower electrode 24 and the upper electrode 26. The drive circuit 28 generates the above drive signals for discharging the ink from the pressure chamber 22*a* and applies the drive signals to the thin-film piezoelectric element 27, and specific examples of the drive signals are described later.

The nozzle substrate 31 is bonded to a side of the pressure chamber 22*a* opposite to the diaphragm 22*b*. The nozzle substrate 31 is provided with a discharge hole (nozzle hole) 31*a* for discharging the ink in the pressure chamber 22*a* as an ink drop to outside. The pressure chamber 22*a* stores the ink supplied from the intermediate tank 6.

In the above structure, when voltages are applied from the drive circuit 28 to the lower electrode 24 and the upper electrode 26, the piezoelectric thin film 25 extends and shrinks in a direction (direction parallel with a surface of the substrate 22) perpendicular to the thickness direction in accordance with a potential difference between the lower electrode 24 and the upper electrode 26. And, because of a length difference between the piezoelectric thin film 25 and the diaphragm 22*b*, a curvature occurs in the diaphragm 22*b*, and the diaphragm 22*b* is displaced (bent, vibrated) in its thickness direction.

Accordingly, when the ink is stored in the pressure chamber 22*a*, a pressure wave is conducted to the ink in the pressure chamber 22*a* by the above vibration of the diaphragm 22*b*, and the ink in the pressure chamber 22*a* is discharged as an ink drop from the discharge hole 31*a* to outside.

[Production Method of Ink-Jet Head]

Figure 4:
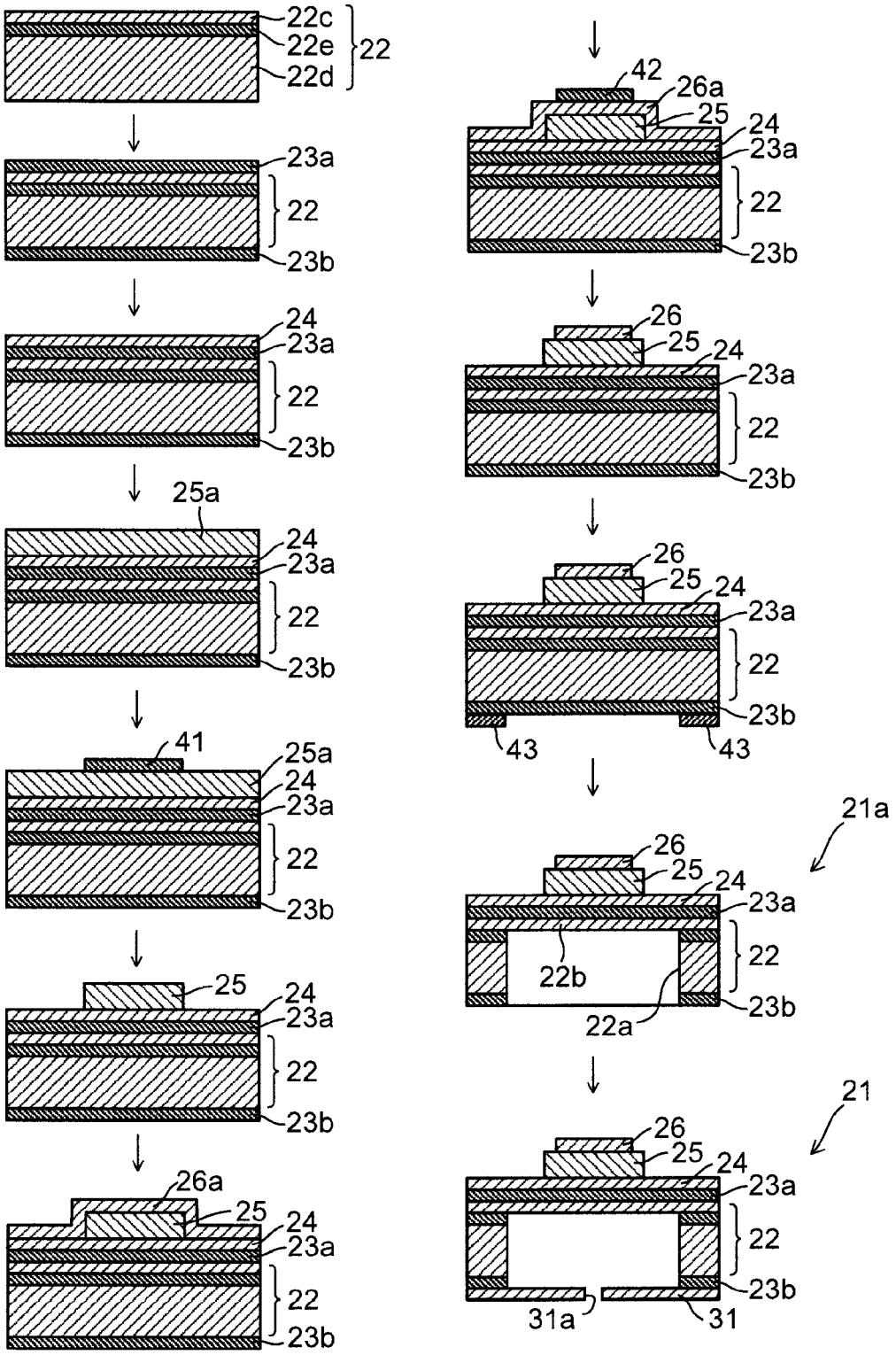
FIG. 4 is a sectional view showing a production process of the above ink-jet head.

Next, a production method of the ink-jet head 21 according to the present embodiment is described hereinafter. FIG. 4 is a sectional view showing a production process of the ink-jet head 21.

First, the substrate 22 is prepared. As the substrate 22, it is possible to use crystalline silicon (Si) that is often used in MEMS (Micro Electro Mechanical Systems), here, a SOI structure is used in which two Si substrates 22*c*•22*d* are bonded via an oxide film 22*e*.

The substrate 22 is put in a heating oven and kept at about 1500° C. for a predetermined time to form thermal oxide films 23*a*•23*b* composed of $SiO_2$ onto surfaces of the Si substrates 22*c*•22*d*. Next, each of a titanium layer and a platinum layer is successively deposited onto one thermal oxide film 23*a* by the sputtering method to form the lower electrode 24.

Next, the substrate 22 is reheated to about 600° C. and a layer 25*a* of lead zirconate titanate (PZT) serving as a displacement film is deposited by the sputtering method. And, a photosensitive resin 41 is applied to the substrate 22 by a spin coating method, light exposing and etching are performed via a mask to remove an unnecessary portion of the photosensitive resin 41 and transfer a shape of the piezoelectric thin film 25 to be formed. Thereafter, with the photosensitive resin 41 used as a mask, the layer 25*a* is shaped by using a reactive ion etching method to form the piezoelectric thin film 25.

Next, a titanium layer and a platinum layer are deposited successively on the lower electrode 24 by the sputtering method covering the piezoelectric thin film 25 to form a layer 26*a*. Then, a photosensitive resin 42 is applied onto the layer 26*a* by the spin coating method, and light exposing and etching are performed via a mask to remove an unnecessary portion of the photosensitive resin 42 and transfer a shape of the upper electrode 26 to be formed. Thereafter, with the photosensitive resin 42 used as a mask, the layer 26*a* is shaped by using the reactive ion etching method to form the upper electrode 26.

Next, a photosensitive resin 43 is applied to a rear surface (opposing the thermal oxide film 22*d*) of the substrate 22 by the spin coating method, and light exposing and etching are performed via a mask to remove an unnecessary portion of the photosensitive resin 43 and transfer a shape of the pressure chamber 22*a* to be formed. And, with the photosensitive resin 43 used as a mask, the substrate 22 is partially removed by the reactive ion etching method to form the pressure chamber 22*a*.

Thereafter, the substrate 22 and the nozzle substrate 31 provided with the discharge hole 31*a* are bonded to each other by using an adhesive and the like. In this way, the ink-jet head 21 is completed. In the meantime, by using an intermediate glass provided with a through-hole at the position corresponding to the discharge hole 31*a* and removing the thermal oxide film 23*b*, the substrate 22 and the intermediate glass may be anodic-bonded to each other, and the intermediate glass and the nozzle substrate 31 may be anodic-bonded to each other. In this case, it is possible to bond the three components (substrate 22, intermediate glass, nozzle substrate 31) without using the adhesive.

In the meantime, the electrode material composing the lower electrode 24 is not limited to the above Pt, and there are other metals or metallic oxides conceivable such as, for example, Au (gold), Ir (iridium), $IrO_2$ (iridium oxide), $RuO_2$ (ruthenium oxide), $LaNiO_3$ (nickelic acid lanthanum), $SrRuO_3$ (ruthenium acid strontium) and the like and combinations of these.

Besides, an orientation control layer (seed layer) composed of PLT (lead lanthanum titanate), $LaNiO_3$, or $SrRuO_3$ may be disposed between the lower electrode 24 and the piezoelectric thin film 25.

Besides, the material composing the piezoelectric thin film 25 is not limited to the above PZT, and there are other materials conceivable such as, for example, PZT with La (lanthanum), Nb (niobium), or Sr (strontium) added, oxides such as $BaTiO_3$ (barium titanate), $LiTaO_3$ (lithium tantalate), Pb (Mg, Nb) $O_3$, Pb (Ni, Nb) $O_3$, $PbTiO_3$ and the like and combinations of these.

[About Drive Signal]

Next, specific examples of drive signals which the drive circuit 28 applies to the thin-film piezoelectric element 27 are described as examples 1 and 2, and also a comparative example for comparison with each example is described.

Example 1

Figure 5:
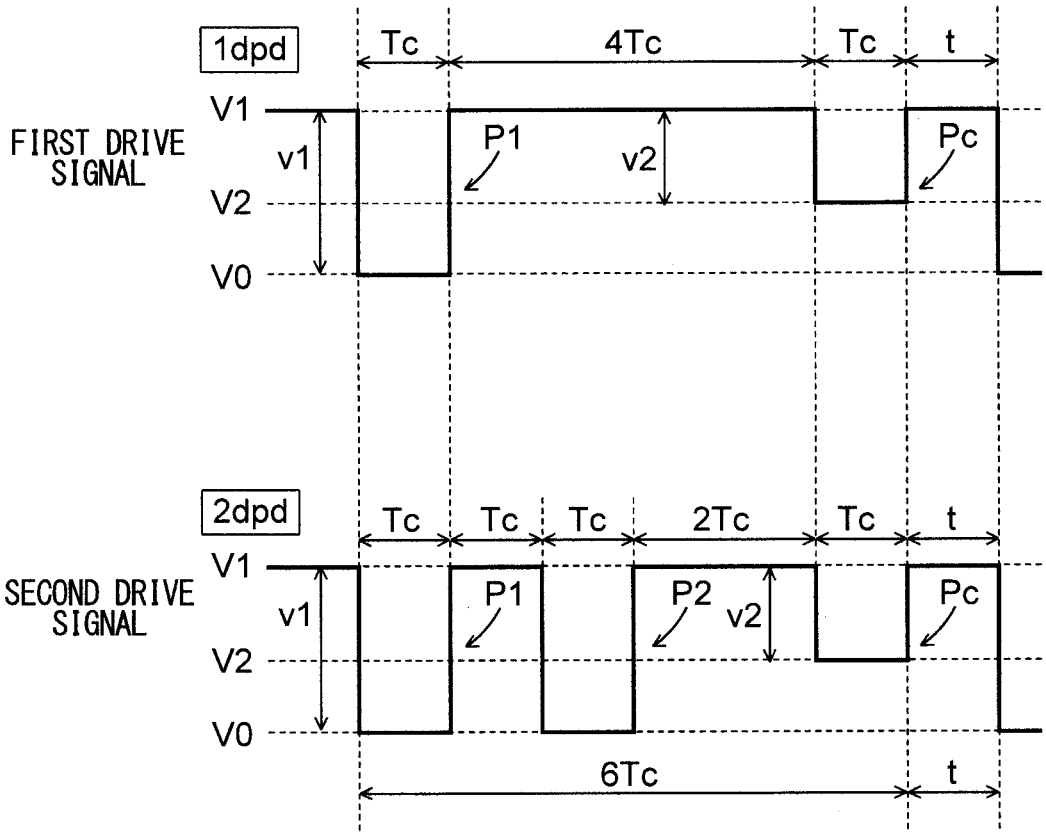
FIG. 5 is a descriptive view showing a waveform of a drive signal in an example 1.
Figure 6:
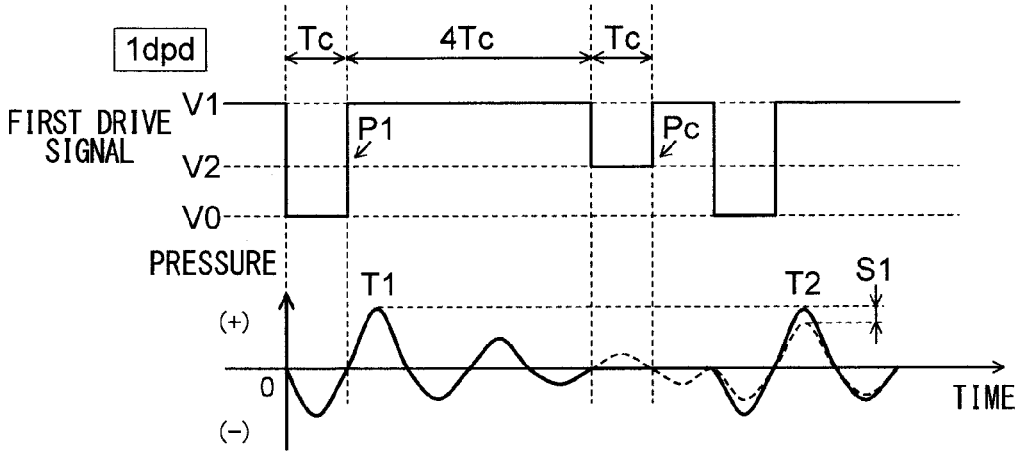
FIG. 6 is a descriptive view showing the waveform of the drive signal in the example 1 and a waveform of a pressure wave generated by drive based on the drive signal.
Figure 6:
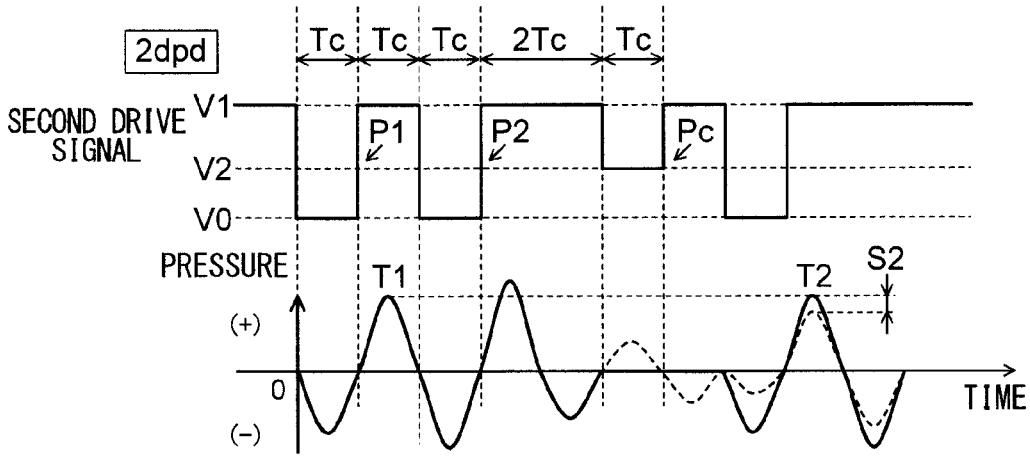

FIG. 5 shows respective waveforms of drive signals in an example 1, that is, a drive signal (also called a first drive signal) in the case of 1 dpd drive where one ink drop is discharged within a period for drawing one pixel (also called a one-pixel period) and a drive signal (also called a second drive signal) in the case of 2 dpd drive where two ink drops are discharged within the one-pixel period. Besides, FIG. 6 shows respective waveforms of the drive signal in the example 1 and a pressure wave that is given to the pressure chamber 22*a* by the drive of the thin-film piezoelectric element 27 based on the drive signal.

The first drive signal and the second drive signal are each a drive signal for discharging an ink drop with the drawing-hitting method with the standby potential V1, for forming a standby state of the thin-film piezoelectric element 27, used as a reference, and include at least one discharge pulse and the cancel pulse. The discharge pulse is a pulse for discharging one ink drop from the pressure chamber 22*a*. The cancel pulse is a pulse for curbing the reverberation of the pressure wave that is given to the pressure chamber 22*a* by the drive of the thin-film piezoelectric element 27 caused by the application of the discharge pulse, here, has the same polarity as the discharge pulse. Hereinafter, details of the first drive signal and second drive signal are described.

(First Drive Signal)

The first drive signal has a discharge pulse P1 composed of a voltage v1 (potential V1-V0) and a cancel pulse Pc composed of a voltage v2 (potential V1-V2) smaller than the voltage v1. In the meantime, units of the voltage and potential are all V (volt). The voltages v1•v2 indicate potential differences (voltage widths) from the standby potential V1.

Here, the one-pixel period indicates an interval from an application start time of the first discharge pulse when drawing a pixel to an application start time of the first discharge pulse when drawing the next pixel, and is set at 6Tc+t in the present embodiment. In the meantime, Tc indicates a half period (e.g., 4 μsec.) of the natural vibration period of the pressure chamber 22*a* containing the ink, and t indicates a period (e.g., 1 μsec.) of shifting from the drawing of a pixel to the drawing of the next pixel. The shorter the period t is, the shorter the time interval when drawing a plurality of pixels becomes, and the plurality of pixels are drawn at a high speed (high frequency).

To discharge an ink drop from the pressure chamber 22*a* with stable discharge characteristics, a pulse width of the discharge pulse P1 is set to be equal to Tc based on the natural vibration period of the pressure chamber 22*a*. When the discharge pulse P1 is applied to the thin-film piezoelectric element 27, as shown in FIG. 6, in a process where the potential decreases from V1 to V0, a pressure wave having a negative pressure is given to the pressure chamber 22*a* by the thin-film piezoelectric element 27, in this way, the ink is pulled into the pressure chamber 22*a*. Thereafter, when the potential rises from V0 to V1, a pressure wave having a positive pressure acts on the pressure chamber 22*a*, in this way, the ink is pushed out from the pressure chamber 22*a*. As a result of this, at a time point T1 shown in FIG. 6, the ink in the pressure chamber 22*a* is discharged as one ink drop from the discharge hole 31*a* at a lower portion of the pressure chamber 22*a*.

Also a pulse width of the cancel pulse Pc is set at Tc like the discharge pulse P1. The cancel pulse Pc is applied to the thin-film piezoelectric element 27 when a time (4Tc) equal to 4 times Tc elapses after the application of the discharge pulse P1 ends within the one-pixel period ends.

Here, if the cancel pulse Pc is not applied (corresponds to a comparative example 1 described later), the pressure wave generated by the application of the discharge pulse P1 vibrates under influence of the reverberation, and is cancelled by the pressure wave (see a solid-line waveform in the 1 dpd in FIG. 6) generated by the discharge pulse P1 when the discharge pulse P1 is applied within the one-pixel period for drawing the next pixel. As a result of this, the pressure wave vibrates as shown by a broken line, and a discharge speed of an ink drop discharged at a time point T2 becomes smaller than a discharge speed of the ink drop discharged at the time point T1 by an amount corresponding to a pressure difference S1.

But, as described above, by applying the cancel pulse Pc having the same polarity as the discharge pulse P1 within the one-pixel period when the time of 4Tc elapses after the application of the discharge pulse P1 ends, it is possible to curb the reverberation by canceling the pressure wave having the positive pressure by the negative pressure due to the discharge pulse P1. In this way, when the discharge pulse P1 is applied within the period for drawing the next pixel, at the time point T2, it is possible to discharge the ink at the substantially same speed as the discharge speed at the time point T1 due to the discharge pulse P1 for the previous pixel (see a solid-line waveform in the 1 dpd).

Besides, for example, within the one-pixel period, if the cancel pulse Pc is applied when the period of Tc elapses after the application of the discharge pulse P1 ends, the pressure wave having the negative pressure is acting on the pressure chamber 22*a* during the application period of the cancel pulse Pc (see FIG. 6). Accordingly, to curb the influence of the reverberation, it is necessary to make the voltage v2 of the cancel pulse Pc have a polarity opposite to the voltage v1 of the discharge pulse P1. In this case, the voltage width of the whole first drive signal becomes wide.

In this point, in the present embodiment, as described above, it is possible to apply the cancel pulse Pc when the pressure wave having the positive pressure acts on the pressure chamber 22*a*. Accordingly, it is possible to make the voltage v2 of the cancel pulse Pc have the same polarity as the voltage v1 of the discharge pulse P1 and thereby narrow the voltage width of the whole first drive signal. As a result of this, it is possible to prevent insulation breakdown of the thin-film piezoelectric element 27 and improve reliability of the thin-film piezoelectric element 27 and ink-jet head 21.

Besides, for example, within the one-pixel period, even if the cancel pulse Pc is applied when the period of 2Tc elapses after the application of the discharge pulse P1 ends, it is possible to make the cancel pulse Pc have the same polarity as the discharge pulse P1. But, in this case, in the 2 dpd drive based on the second drive signal described later, when the cancel pulse Pc is applied at the same timing as the first drive signal, the cancel pulse Pc becomes continuous with the second discharge pulse P2 within the one-pixel period. Accordingly, it is possible to prevent the structure of the drive circuit 28 from becoming complicated by using the same application timing in the first drive signal and the second drive signal, but it becomes impossible to perform stably the second ink discharge within the one-pixel period.

But, in the present example, it is possible to secure the sufficient interval (2Tc) between the second discharge pulse P2 and the cancel pulse Pc. Accordingly, it is possible to prevent the second ink discharge from being made unstable by the application of the cancel pulse Pc.

(Second Drive Signal)

As shown in FIG. 5, the second drive signal includes, within the one-pixel period, the two discharge pulses P1•P2 composed of the voltage v1 (potential V1-V0) and the cancel pulse Pc composed of the voltage v2 (potential V1-V2). The pulse widths and pulse intervals of the discharge pulses P1•P2 are all Tc.

In the second drive signal, within the one-pixel period, the second discharge pulse P2 is applied when the period of Tc elapses after the application of the first discharge pulse P1 ends. In the meantime, the ink drop discharged by the first discharge pulse P1 and the ink drop discharged by the second discharge pulse P2 join each other into one drop after being discharged which hits the recording medium as one ink drop for the same pixel.

The cancel pulse Pc is a pulse that curbs the influence of the reverberation of the pressure wave given to the pressure chamber 22*a* and its pulse width is set at Tc. Besides, the voltage v2 of the cancel pulse Pc has the same polarity as the voltage v1 of the discharge pulses P1•P2. As shown in FIG. 5, like the first drive signal, the cancel pulse Pc is applied when 4Tc elapses after the application of the first discharge pulse P1 ends. Accordingly, the application timing of the cancel pulse Pc in the second drive signal is equal to the application timing of the cancel pulse Pc in the first drive signal.

Here, in the case where the cancel pulse Pc is not applied (corresponds to the comparative example 1 described later), the pressure waves generated by the applications of the discharge pulses P1•P2 vibrate because of the influence of the reverberation, and are cancelled by the pressure wave (see a solid-line waveform in the 2 dpd in FIG. 6) generated by the discharge pulse P1 when the first discharge pulse P1 is applied within the one-pixel period for drawing the next pixel. As a result of this, the pressure wave vibrates as shown by a broken line in FIG. 6, and the discharge speed of the ink drop discharged at the time point T2 becomes smaller than the discharge speed of the ink drop discharged at the time point T1 by an amount corresponding to a pressure difference S2.

But, as described above, by applying the cancel pulse Pc having the same polarity as the discharge pulses P1•P2 within the one-pixel period when the time of 4Tc elapses after the application of the first discharge pulse P1 ends, it is possible to curb the reverberation. In this way, when the discharge pulse P1 is applied within the period for drawing the next pixel, at the time point T2, it is possible to discharge the ink at the substantially same speed as the discharge speed at the time point T1 due to the discharge pulse P1 for the previous pixel (see a solid-line waveform in the 2 dpd).

Besides, the voltage v2 of the cancel pulse Pc has the same polarity as the voltage v1 of the discharge pulses P1•P2. Accordingly, the voltage width used in the second drive signal narrows, and it is possible to improve the reliability of the thin-film piezoelectric element 27 and ink-jet head 21.

As described above, the cancel pulse Pc is applied when the time of 4 times Tc elapses from the application end time of the first discharge pulse within the one-pixel period. Accordingly, even in the case of the 1 dpd drive that uses the first drive signal and the case of the 2 dpd drive that uses the second drive signal, it is possible to apply the discharge pulse in accordance with the natural vibration period of the pressure chamber 22*a*, and it is possible to use the same application timing of the cancel pulse Pc in the cases of the 1 dpd and the 2 dpd. In this way, it is possible to perform the multi-gradation drawing while preventing the structure of the drive circuit 28 for generating the drive signal from becoming complicated. Besides, in the case of the 2 dpd, it is possible to secure the time equal to the natural vibration period (2Tc) of the pressure chamber 22*a* before the application of the cancel pulse Pc after the second discharge pulse P2 is applied within the one-pixel period. Accordingly, it is possible to prevent the ink discharge caused by the application of the second discharge pulse P2 from being made unstable by the application of the cancel pulse Pc, and possible to perform stably the multi-gradation drawing.

Besides, by applying the cancel pulse Pc having the same polarity as the discharge pulse at the above timing, it is possible to reduce the reverberation efficiently and sufficiently by forcing the negative pressure due to the cancel pulse Pc to act when the positive pressure acts on the pressure chamber 22*a* because of the reverberation. In this way, even in the case where the period t is shortened to perform the drawing of a plurality of pixels at a high speed, it is possible to perform stably the ink discharge due to the first discharge pulse P1 for every drawing of each pixel.

As described above, according to the drive method of the ink-jet head in the present example, it is possible to perform the stable ink discharge, in both the 1 dpd drive and the 2 dpd drive, perform stably the multi-gradation drawing, and shorten the drive period of each pixel. As a result of this, it is possible to achieve the high-performance ink-jet printer that can form a high-definition image at a high speed.

Besides, in the second drive signal, the pulse widths and pulse intervals of the plurality of discharge pulses P1•P2 are all Tc. Accordingly, in the case where the 2 dpd drive is performed, it is possible to perform efficiently the ink discharge in accordance with the natural vibration period of the pressure chamber 22*a*.

In the meantime, in the present example, the negative pressure is made to act on the pressure chamber 22*a* by using the cancel pulse Pc that has the same polarity as the discharge pulse P1. Accordingly, if the cancel pulse Pc is applied when the positive pressure acts on the pressure chamber 22*a* because of the reverberation, it is possible to curb the reverberation. If a time point when the time of 4 times Tc elapses after the application of the first discharge pulse P1 ends within the one-pixel period is Ta, after Ta, in both the 1 dpd drive and the 2 dpd drive, the time when the positive pressure acts on the pressure chamber 22*a* because of the reverberation appears whenever a time, which is Tc times an even number, elapses after Ta. Accordingly, it can be said that if the cancel pulse Pc is applied when the time equal to an even number times Tc, which is equal to 4 times Tc or longer (Tc times an even number greater than or equal to 4), elapses within the one-pixel period after the application of the first discharge pulse P1 ends, the reverberation is curbed and the same effects as the present example are obtained.

Especially, as in the present example, within the one-pixel period, if the cancel pulse Pc is applied when the time of 4 times Tc elapses from the application end time of the first discharge pulse P1, it is possible to make shortest the period from the application of the first discharge pulse P1 to the application of the cancel pulse Pc, apply the second discharge pulse P2 without interference with the cancel pulse Pc within the shortest period and thereby achieve the multi-gradation drawing. Accordingly, it is most effective in the case where a plurality of pixels are drawn at a high speed and with the multi-gradation.

Besides, within the one-pixel period, if the cancel pulse Pc is applied when a time equal to an even number times Tc, which is equal to 6 times Tc or longer, elapses from the application end time of the first discharge pulse P1, it becomes possible to apply 3 or more discharge pulses within the one-pixel period. In this case, it becomes possible to perform more-gradation drawing by discharging 3 or more ink drops within the one-pixel period.

In the meantime, in a case where a total of n discharge pulses are applied at the pulse width and pulse interval of Tc within the one-pixel period with n being an integer of 2 or larger, the cancel pulse Pc may be applied at the application timing when a time of 2n•Tc elapses after the application of the first discharge pulse P1 ends within the one-pixel period.

In the meantime, in the present example, the pulse width of the cancel pulse Pc is Tc, but is not limited to Tc and may be larger than Tc or smaller than Tc. In short, the pulse width of the cancel pulse Pc may be suitably set within a range where the reverberation can be curbed.

Example 2

Figure 7:
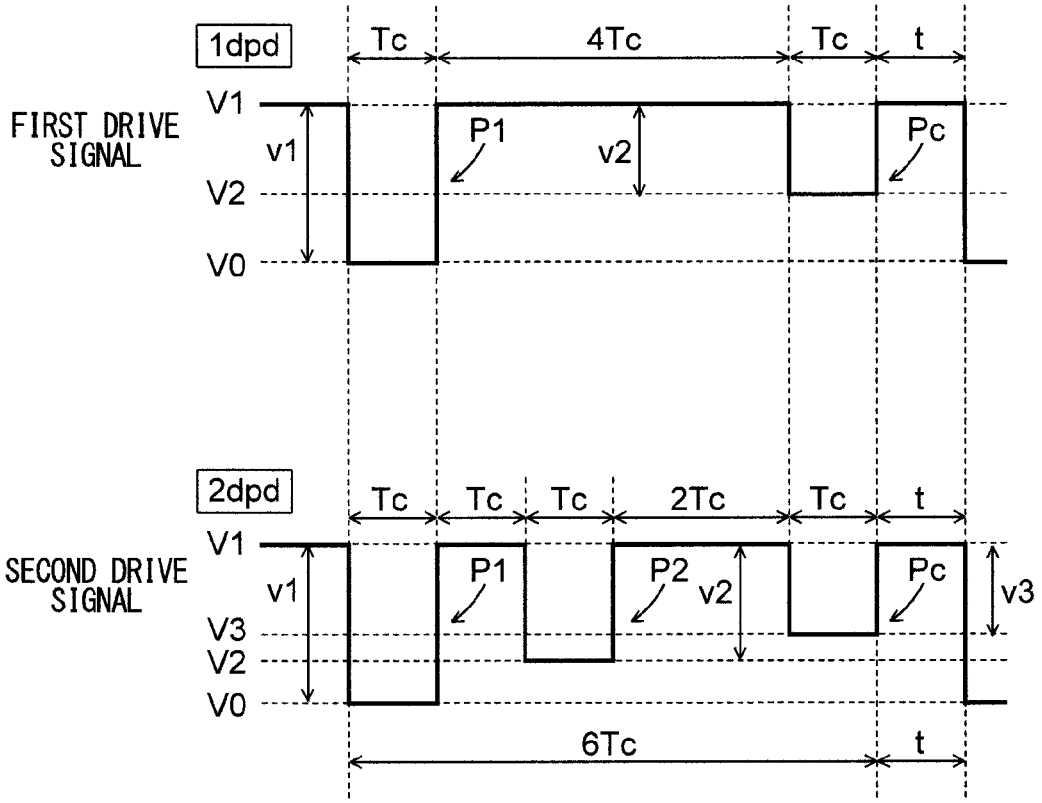
FIG. 7 is a descriptive view showing a waveform of a drive signal in an example 2.
Figure 8:
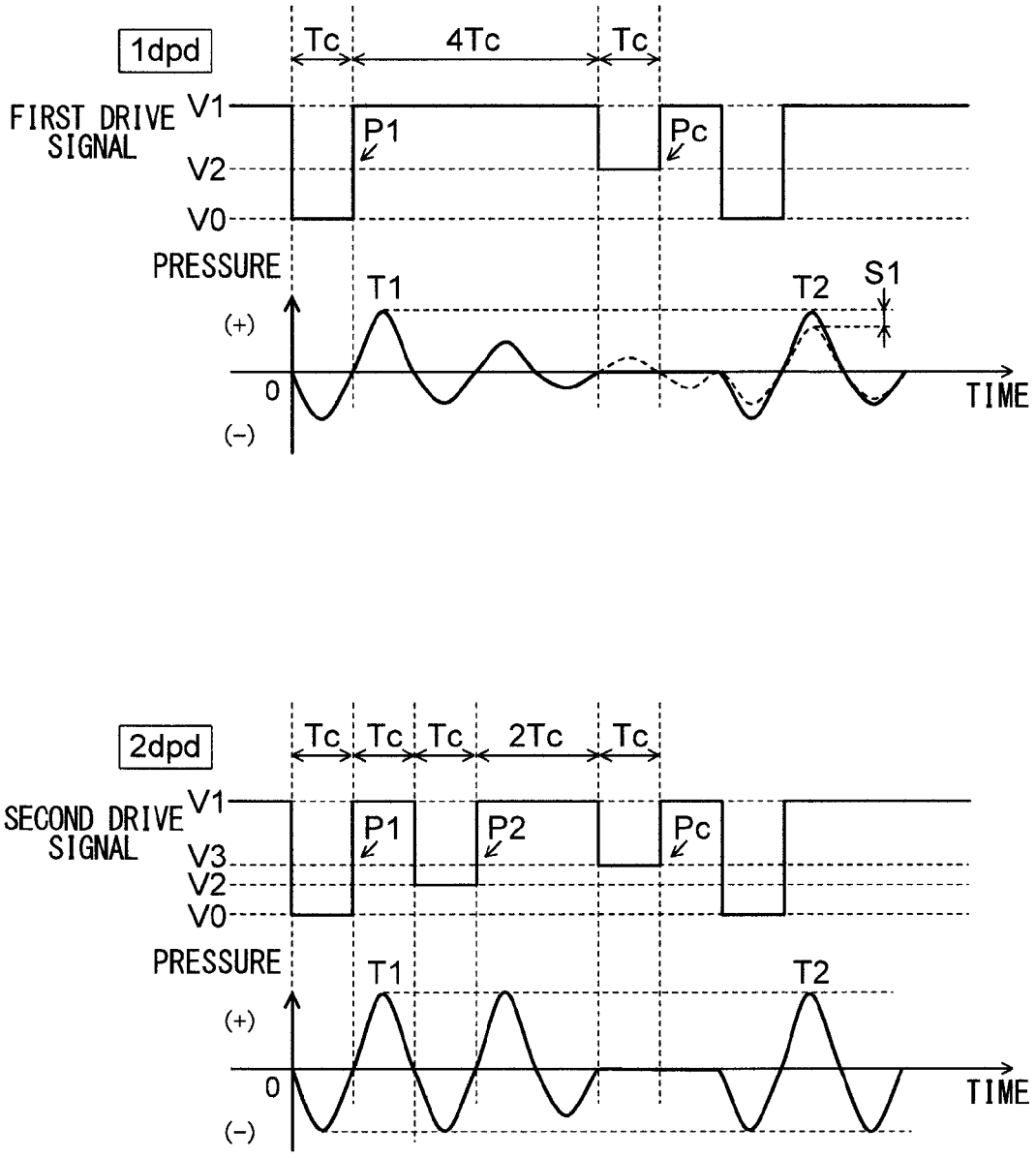
FIG. 8 is a descriptive view showing the waveform of the drive signal in the example 2 and a waveform of a pressure wave generated by drive based on the drive signal 1.

FIG. 7 shows waveforms of drive signals (first drive signal, second drive signal) in an example 2, and FIG. 8 shows respective waveforms of pressure waves given to the pressure chamber 22*a* by the drive of the thin-film piezoelectric element 27 based on the drive signals. The example 2 is the same as the first example 1 except that in the second drive signal, the potentials (potential difference from the standby potential V1, voltage width, pulse depth) of a plurality of discharge pulses P1•P2 are different from each other within the one-pixel period. More specifically, in the second drive signal, the potential V0 of the discharge pulse P1 and the voltage V2 of the discharge pulse P2 are set with the standby potential V1 used as a reference in such a way that the voltage v2 (potential V1-V2) of the discharge pulse P2 becomes smaller than the voltage v1 (potential V1-V0) of the discharge pulse P1. In the meantime, a voltage v3 (potential V1-V3) of the cancel pulse Pc is smaller than the voltage v2 of the discharge pulse P2.

As in the present example, by making the potentials V0•V2 (voltages v1•v2) of the discharge pulses P1•P2 different from each other within the one-pixel period, it is possible to control a size of the pressure wave, which is given to the pressure chamber 22*a* at the discharge time of the second ink drop, to be different from the first drop discharged. Such control is effective in the stable ink discharge. Besides, by adjusting the size of the pressure wave as described above, it is also possible to adjust the speed and size of the ink drop.

Besides, in the above example 1, the voltages of both discharge pulses P1•P2 are set at the same voltage v1 within the one-pixel period. In this case, because of the influence of the reverberation due to the application of the first discharge pulse P1, the size (amplitude) of the pressure wave generated by the application of the second discharge pulse P2 becomes larger than the pressure wave generated by the application of the first discharge pulse P1 (see a waveform in the 2 dpd in FIG. 6).

In this point, as in the present example, by making the voltage v2 of the discharge pulse P2 smaller than the voltage v1 of the discharge pulse P1, as shown in FIG. 8, with the influence of the reverberation considered, it is possible to make constant the sizes of the pressure waves that are given to the pressure chamber 22*a* at the discharge times of the first and second drops. In this way, it becomes possible to perform the more stable ink discharge.

Besides, in the case where the sizes of the pressure waves that are given to the pressure chamber 22*a* at the application times of the discharge pulses P1•P2 are constant, the vibration amplitudes of the diaphragm 22*b* equalize to each other at the application times of the discharge pulses P1•P2. It is known that if the vibration amplitude of the diaphragm 22*b* changes, a piezoelectric characteristic (piezoelectric constant $d_{31}$) of the piezoelectric thin film 25 over the diaphragm 22*b* changes when a continuous drive is performed, the stable ink discharge characteristic is not obtained, and drawing defects such as pixel deviation and the like occur. Accordingly, by making constant the sizes of the pressure waves generated by the applications of the discharge pulses P1•P2, it is possible to equalize the vibration amplitudes of the diaphragm 22*b*, curb the change in the piezoelectric characteristic of the piezoelectric thin film 25 and thereby curb the drawing defects of an image.

Because of this, it can be said that to stabilize the piezoelectric characteristic of the piezoelectric thin film 25, the potentials V0•V2 (voltages v1•v2) of the plurality of discharge pulses P1•P2 are set in such a way that the vibration amplitudes of the diaphragm equalize to each other at the application times of the respective discharge pulses P1•P2.

In the present example, the case, where the two discharge pulses are included in the second drive signal within the one-pixel period, is described. But, it is possible to consider, in the same way as in the present example, a case where 3 or more pulses are included. In other words, by making the voltage (potential difference from the standby potential V1) of the later discharge pulse smaller, it is possible to make constant the sizes of the pressure waves that are given to the pressure chamber 22*a* at the discharge times of the respective ink drops and thereby perform the stable ink discharge.

In the meantime, in the present example, the voltage v2 of the discharge pulse P2 is made larger than the voltage v1 of the discharge pulse P1, but, the voltage v2 may be made smaller than the voltage v1. In the case where the multi-gradation drawing is performed at a high speed, if too many discharge pulses are included within the one-pixel period, there is a case where the drawing of one pixel takes a long time and it becomes impossible to draw a plurality of pixels at a high speed. As described above, if the voltage v2 is made larger than the voltage v1 within the one-pixel period, it is possible to perform the multi-gradation drawing by using a small number of discharge pulses and becomes effective in a case of pursuing higher-speed multi-gradation drawing.

In the meantime, in the case where the voltage v2 is made larger than the voltage v1, from the viewpoint of securing the reliability of the thin-film piezoelectric element 27 and ink-jet head 21, it is desirable that the voltages v1•v2 are set not to exceed a withstand voltage of the thin-film piezoelectric element 27.

Comparative Example 1

Figure 9:
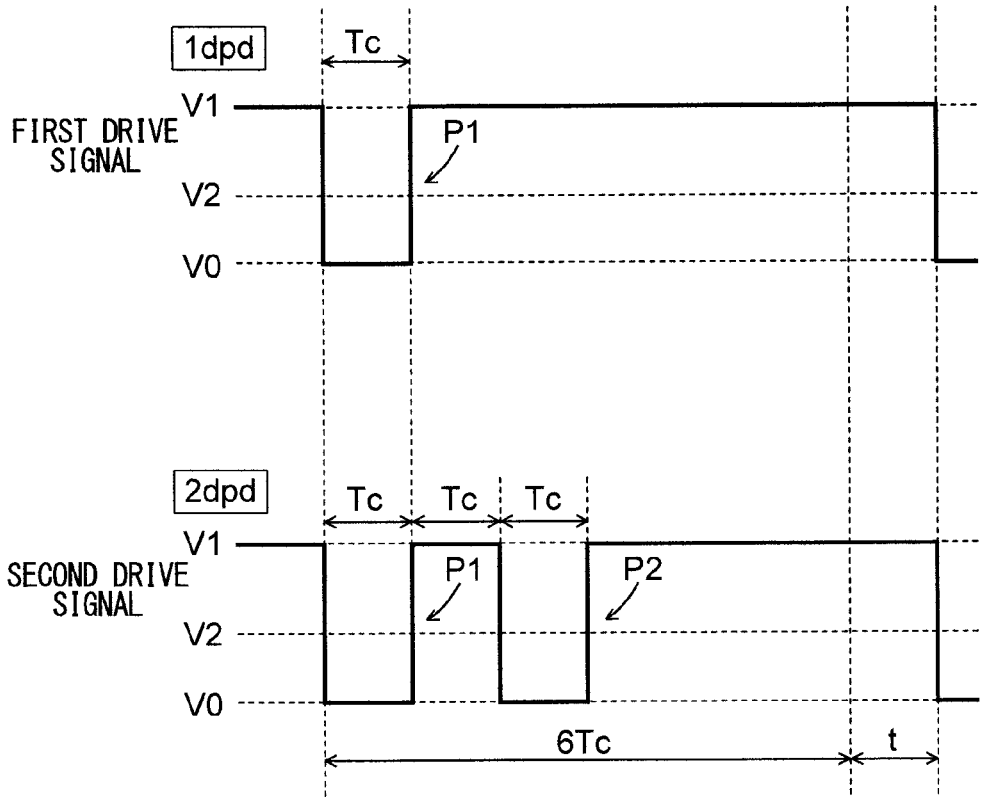
FIG. 9 is a descriptive view showing a waveform of a drive signal in a comparative example.

FIG. 9 shows waveforms of drive signals (first drive signal, second drive signal) in a comparative example 1. In the comparative example 1, there are no cancel pulses included in both the first drive signal and the second drive signal. Waveforms of the pressure waves, which are given to the pressure chamber 22*a* by the drive of the thin-film piezoelectric element 27 based on such drive signals, are indicated by broken lines in FIG. 6.

In the comparative example 1, there are no cancel pulses included in the drive signals. Accordingly, even if the first discharge pulse P1 is applied within the next one-pixel period, because of the influence of the reverberation based on the application of the discharge pulse in the previous pixel period, the discharge speed of the ink drop discharged at the time point T2 becomes smaller than the discharge speed of the ink drop discharged at the time point T1 within the previous pixel period by the amount corresponding to the pressure difference S1 or S2. As described above, the ink discharge speeds in the drawing of the second and subsequent pixels change. Accordingly, pixel deviation and the like occur in the high-speed drawing, and it becomes impossible to obtain a high-definition image stably.

[About Pulse Waveform]

Figure 10:
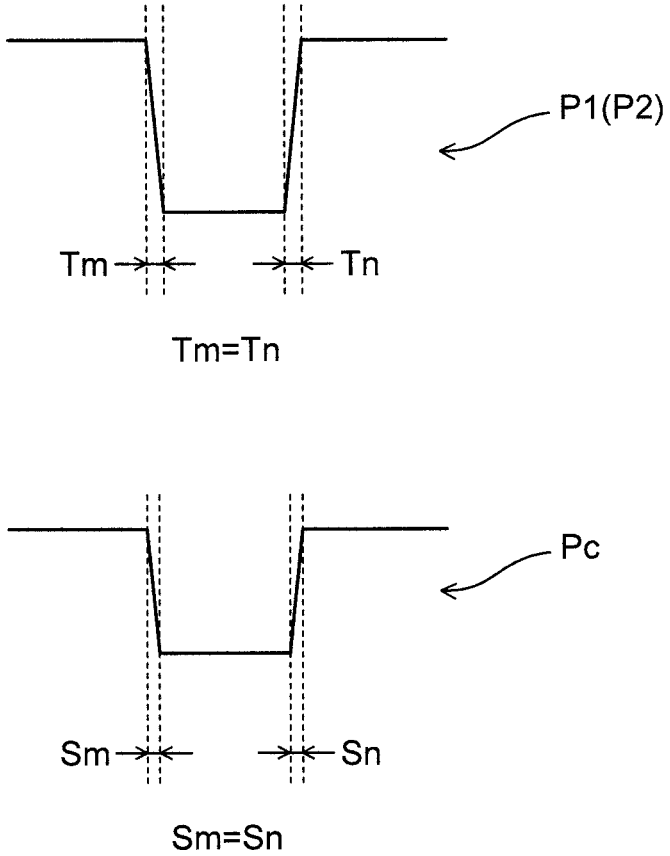
FIG. 10 is a descriptive view enlarging and showing a discharge pulse or a cancel pulse included in the drive signals in the examples 1 and 2.
Figure 11:
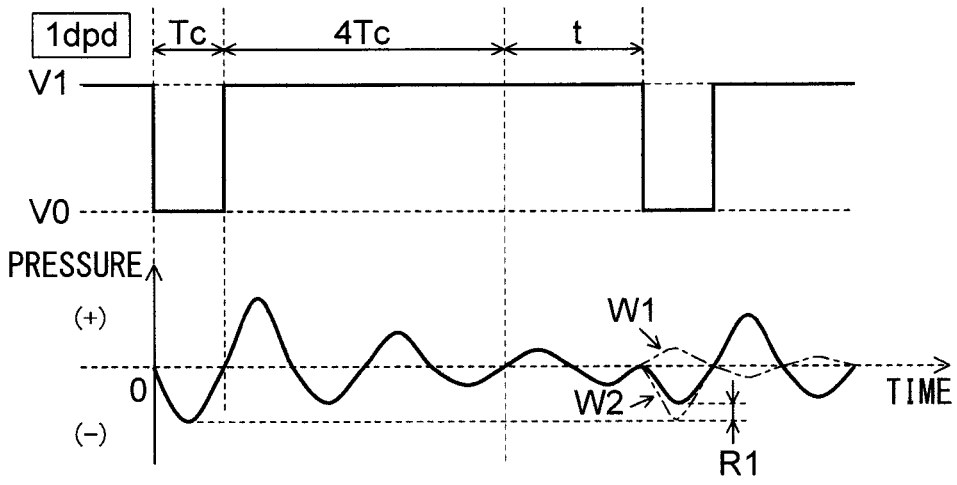
FIG. 11 is a descriptive view showing respective drive signals when t=2Tc and t=Tc in a 1 dpd drive method and pressure waves generated by drive based on the drive signals.
Figure 11:
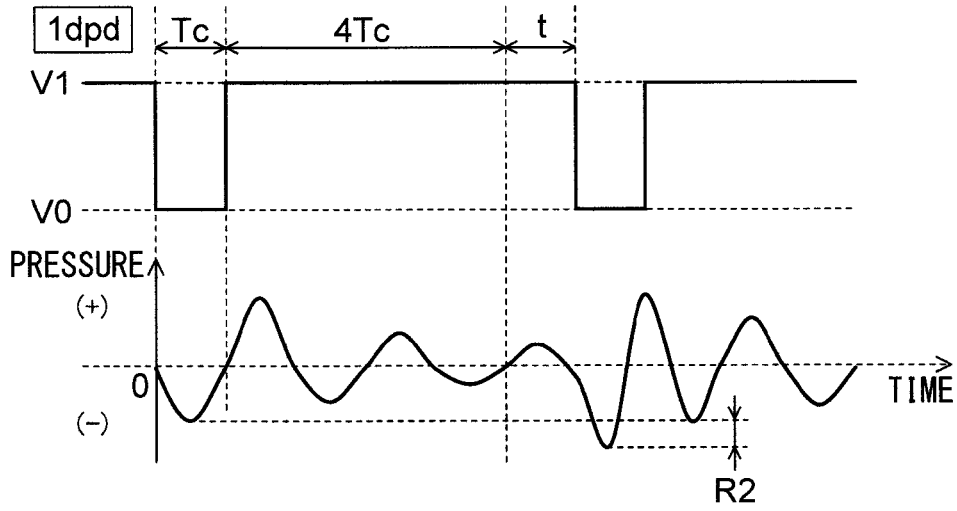

FIG. 10 enlarges and shows the discharge pulses (discharge pulses P1•P2) and the cancel pulse Pc included in the drive signals of the examples 1 and 2. It is desirable that the discharge pulse P1 (P2) is a pulse wave in which a falling time Tm (μsec.) and a rising time Tn (μsec.) are the same as each other. Besides, it is also desirable that the cancel pulse Pc is a pulse wave in which a falling time Sm (μsec.) and a rising time Sn (μsec.) are the same as each other. Such pulse waves include trapezoidal waves and rectangular waves (square waves) shown in FIG. 5 to FIG. 8. In a case of the rectangular wave, Tm, Tn, Sm, and Sn are all close to 0 limitlessly.

As described above, in the case where the discharge pulses P1•P2 and the cancel pulse Pc are each a simple pulse wave in which the falling time and the rising time are equal to each other, it is possible to produce a drive signal including such pulse waves by using a digital circuit which includes a logic circuit and the like, and possible to compose the drive circuit 28 by using the digital circuit. In this case, compared with a case where the drive circuit 28 is composed by using an analog circuit, it becomes easy to produce the drive circuit 28.

The ink-jet head according to the present embodiment described above is an ink-jet head that includes: a pressure chamber that stores ink; a thin-film piezoelectric element that is driven based on a drive signal for discharging the ink in the pressure chamber to outside; and a drive circuit that generates the drive signal and applies the drive signal to the thin-film piezoelectric element; the drive signal includes: at least one discharge pulse that discharges one ink drop from the pressure chamber; and a cancel pulse that has a same polarity as the discharge pulse and curbs a reverberation of a pressure wave which is given to the pressure chamber by the driving of the thin-film piezoelectric due to an application of the discharge pulse, and when a half period of a natural vibration period of the pressure chamber is Tc, the cancel pulse is applied when a time, which is Tc times an even number greater than or equal to 4, elapses after an application of a first discharge pulse ends within a period for drawing one pixel.

By setting the application timing of the cancel pulse as described above, for example, even in the case of the 1 dpd drive in which one discharge pulse is applied within the one-pixel period and in the case of the 2 dpd drive in which two discharge pulses are applied within the one-pixel period, it is possible to apply the discharge pulse to the thin-film piezoelectric element in accordance with the natural vibration period of the pressure chamber and it is possible to use the same application timing of the cancel pulse in the 1 dpd drive and the 2 dpd drive. In this way, it is possible to perform the multi-gradation drawing by combining the 1 dpd drive and the 2 dpd drive with each other while avoiding the complication of the structure of the drive circuit for generating the drive signal. Besides, in the 2 dpd drive, when applying each discharge pulse in accordance with the natural vibration period of the pressure chamber, it is possible to secure the time equal to or longer (e.g., 2Tc) than the natural vibration period of the pressure chamber before the application of the cancel pulse after the second discharge pulse is applied within the one-pixel period. In this way, it is possible to prevent the ink discharge due to the application of the second discharge pulse from being made unstable by the application of the cancel pulse, and possible to perform stably the multi-gradation drawing.

Besides, by applying the cancel pulse having the same polarity as the discharge pulse at the above timing, it is possible to reduce the reverberation of the pressure wave efficiently and sufficiently. In this way, even if the period from the application end of the cancel pulse to the application start of the next discharge pulse is shortened (even if the drive period per one pixel is shortened), it is possible to perform stably the ink discharge due to the first discharge pulse for every drawing of each pixel. Accordingly, it is also possible to sufficiently deal with the high-speed drawing of a plurality of pixels.

In other words, according to the above structure, it is possible to perform stably the multi-gradation drawing while avoiding the complication of the drive circuit, shorten the drive period of one pixel and thereby achieve the high-speed and stable drawing.

When a plurality of the discharge pulses are applied within the period for drawing one pixel, both a pulse width and a pulse interval of the plurality of the discharge pulses may be equal to Tc. In this case, for example, even in the case where the 2 dpd drive is performed, it is possible to drive the thin-film piezoelectric element in accordance with the natural vibration period of the pressure chamber and thereby perform the ink discharge efficiently.

The potentials of the plurality of the discharge pulses may be different from one another within the period for drawing one pixel. In this case, when discharging the second and subsequent ink drops, it is possible to control the sizes of the pressure waves given to the pressure chamber, which is effective in the stable ink discharge. Besides, by adjusting the size of the pressure wave, it is also possible to adjust the speed and size of the ink drop.

Within the period for drawing one pixel, a later discharge pulse may have a smaller voltage difference from a standby potential. In this case, it is possible to bring the size of the pressure wave, which is given to the pressure chamber by each discharge pulse, to a constant and thereby perform a more stable ink discharge.

The ink-jet head further includes a diaphragm that vibrates according to the drive of the thin-film piezoelectric element to give a pressure to the ink in the pressure chamber, wherein within the period for drawing one pixel, the potentials of the plurality of the discharge pulses may be set in such a way that vibration amplitudes of the diaphragm at the application times of the respective discharge pulses equalize to one another.

The vibration amplitudes of the diaphragm at the application times of the respective discharge pulses equalize to one another. Accordingly, even in the case where the thin-film piezoelectric element is driven continuously, it is possible to curb a change in the piezoelectric characteristic (e.g., a piezoelectric constant $d_{31}$) and achieve the ink-jet head that has the stable characteristic.

The cancel pulse may be applied when a time equal to 4 times Tc elapses from the application end time of the first discharge pulse within the period for drawing one pixel.

In this case, within the one-pixel period, the period from the application of the first discharge pulse to the application of the cancel pulse is shortest, which is most effective in achieving the high-speed drawing by shortening the drive period for one pixel.

It is desirable that the discharge pulse and the cancel pulse are pulse waves that have respective falling times and rising times which are equal to each other.

In this case, it is possible to compose the drive circuit generating the drive signal by using a digital circuit, and compared with a case where the drive circuit is composed by using an analog circuit, it is easy to produce the drive circuit.

The ink-jet printer according to the present embodiment described above includes the above ink-jet head, and discharges the ink from the ink-jet head to a recording medium. In this case, it is possible to achieve the high-performance ink-jet printer that can apply stably the multi-gradation and high-speed drawing to the recording medium.

The method for driving an ink-jet head according to the present embodiment described above is a method for driving an ink-jet head that applies a drive signal to a thin-film piezoelectric element to discharge ink in a pressure chamber to outside, wherein the drive signal includes: at least one discharge pulse that discharges one ink drop from the pressure chamber; and a cancel pulse that has a same polarity as the discharge pulse and curbs a reverberation of a pressure wave which is given to the pressure chamber by drive of the thin-film piezoelectric due to an application of the discharge pulse, and when a half period of a natural vibration period of the pressure chamber is Tc, the cancel pulse is applied to the thin-film piezoelectric element when a time, which is Tc times an even number greater than or equal to 4, elapses from an application end time of a first discharge pulse within a period for drawing one pixel. According to such a drive method, it is possible to perform stably the multi-gradation drawing while avoiding the complication of the drive circuit, shorten the drive period of one pixel and thereby achieve the high-speed and stable drawing.

INDUSTRIAL APPLICABILITY

The ink-jet head according to the present invention is applicable to ink-jet printers.

REFERENCE SIGNS LIST

1 ink-jet printer
21 ink-jet head
22*a* pressure chamber
22*b* diaphragm
27 thin-film piezoelectric element
28 drive circuit

The invention claimed is:

1. An ink-jet head comprising:

a pressure chamber that stores ink, a thin-film piezoelectric element that is driven based on a drive signal for discharging the ink in the pressure chamber to outside, and a drive circuit that generates the drive signal and applies the drive signal to the thin-film piezoelectric element, wherein the drive signal includes:

at least one discharge pulse that discharges one ink drop from the pressure chamber; and a cancel pulse that has a same polarity as the discharge pulse and curbs a reverberation of a pressure wave which is given to the pressure chamber by the drive of the thin-film piezoelectric due to an application of the discharge pulse, and when a half period of a natural vibration period of the pressure chamber is Tc, the cancel pulse is applied when a time, which is Tc times an even number greater than or equal to 4, elapses after an application of a first discharge pulse ends within a period for drawing one pixel;

wherein the at least one discharge pulse includes:

a first discharge pulse that discharges a first ink drop from the pressure chamber within the period for drawing one pixel, and a second discharge pulse that follows the first discharge pulse and discharges a second ink drop from the pressure chamber within the period for drawing one pixel;

wherein the drive signal further includes:

a first drive signal that has the first discharge pulse, and a second drive signal that has the first discharge pulse and the second discharge pulse, wherein the cancel pulse, included in the first drive signal and the second drive signal, is applied when a time, which is Tc times an even number greater than or equal to 4, elapses after an application of the first discharge pulse ends within the period for drawing one pixel.

2. The ink-jet head according to claim 1, wherein the drive signal includes a plurality of the discharge pulses within the period for drawing one pixel.

3. The ink-jet head according to claim 1, wherein when a plurality of the discharge pulses are applied within the period for drawing one pixel, both a pulse width and a pulse interval of the plurality of the discharge pulses are equal to Tc.

4. The ink-jet head according to claim 3, wherein potentials of the plurality of the discharge pulses are different from one another within the period for drawing one pixel.

5. The ink-jet head according to claim 4, wherein within the period for drawing one pixel, a later discharge pulse has a smaller voltage difference from a standby potential.

6. The ink-jet head according to claim 5, further comprising:

a diaphragm that vibrates according to the drive of the thin-film piezoelectric element to give a pressure to the ink in the pressure chamber, wherein within the period for drawing one pixel, the potentials of the plurality of the discharge pulses are set in such a way that vibration amplitudes of the diaphragm at application times of respective discharge pulses equalize to one another.

7. The ink-jet head according to claim 1, wherein the cancel pulse is applied when a time equal to 4 times Tc elapses from the application end time of the first discharge pulse within the period for drawing one pixel.

8. The ink-jet head according to any one of claim 1, wherein the discharge pulse and the cancel pulse are pulse waves that have respective falling times and rising times which are equal to each other.

9. An ink-jet printer comprising an ink-jet head according to claim 1, wherein the ink-jet printer discharges ink from the ink-jet head to a recording medium.

10. A method for driving an ink-jet head that applies a drive signal to a thin-film piezoelectric element to discharge ink in a pressure chamber to outside, wherein the drive signal includes:

at least one discharge pulse that discharges one ink drop from the pressure chamber; and a cancel pulse that has a same polarity as the discharge pulse and curbs a reverberation of a pressure wave which is given to the pressure chamber by drive of the thin-film piezoelectric due to an application of the discharge pulse, and when a half period of a natural vibration period of the pressure chamber is Tc, the cancel pulse is applied to the thin-film piezoelectric element when Tc times an even number greater than or equal to 4 elapses from an application end time of a first discharge pulse within a period for drawing one pixel;

wherein the at least one discharge pulse includes:

a first discharge pulse that discharges a first ink drop from the pressure chamber within the period for drawing one pixel, and a second discharge pulse that follows the first discharge pulse and discharges a second ink drop from the pressure chamber within the period for drawing one pixel;

wherein the drive signal further includes:

a first drive signal that has the first discharge pulse, and a second drive signal that has the first discharge pulse and the second discharge pulse, wherein the cancel pulse, included in the first drive signal and the second drive signal, is applied when a time, which is Tc times an even number greater than or equal to 4, elapses after an application of the first discharge pulse ends within the period for drawing one pixel.

11. The method for driving an ink-jet head according to claim 10, wherein the drive signal includes a plurality of the discharge pulses within the period for drawing one pixel.

* * * * *